US005599064A

United States Patent [19]

Vanderminden, Sr.

[11] Patent Number: 5,599,064

[45] Date of Patent: Feb. 4, 1997

[54] SWIVEL ROCKER

[75] Inventor: Robert D. Vanderminden, Sr., Granville, N.Y.

[73] Assignee: Telescope Casual Furniture Co., Granville, N.Y.

[21] Appl. No.: 508,056

[22] Filed: Jul. 27, 1995

[51] Int. Cl.[6] ..... A47C 1/02

[52] U.S. Cl. ..... 297/344.21; 297/258.1

[58] Field of Search ..... 297/463.1, 344.21, 297/344.22, 344.26, 344.25, 302.1, 302.3, 258.1, 272.1, 325, 326, 452.18, 452.2, 445.1; 248/415

[56] References Cited

U.S. PATENT DOCUMENTS

| | | | |
|---|---|---|---|
| 113,967 | 4/1871 | Barber | 248/415 X |
| 1,377,332 | 5/1921 | Franz | 248/415 X |
| 2,313,559 | 3/1943 | Larsen et al. | 297/302.1 X |
| 2,339,953 | 1/1944 | Schlorman | 297/344.21 X |
| 3,297,360 | 1/1967 | Holmstrom | 297/302.1 |
| 3,337,265 | 8/1967 | Benzing | 297/302.1 |
| 4,577,907 | 3/1986 | Talmon et al. | 297/DIG. 2 X |
| 4,830,324 | 5/1989 | Neville | 297/344.21 X |
| 4,971,394 | 11/1990 | Vanderminden | 297/344.21 |
| 5,039,164 | 8/1991 | Gibbs | 297/344.26 X |

*Primary Examiner*—Milton Nelson, Jr.
*Attorney, Agent, or Firm*—McAulay Fisher Nissen Goldberg & Kiel, LLP

[57] ABSTRACT

The connection unit for the swivel rocker employs a hollow vertical pivot pin which is received within the base to permit rotation about a vertical axis. The connection unit employs a pair of U-shaped flexures which provide for a soft rocking motion. These flexures are connected to the pivot pin via a composite beam which imparts side-to-side stability to the swivel rocker.

14 Claims, 2 Drawing Sheets

SWIVEL ROCKER

This invention relates to a swivel rocker. More particularly, this invention relates to a connection unit for a swivel rocker.

Heretofore, various types of chairs have been known which can be provided with swivel connections to allow a seated occupant to rotate about a vertical axis. In addition, several types of these chairs have been provided with a pivot mechanism which allows the back of the chair to be pivoted forwardly and backwardly relative to a fixed seat. Still other chairs have been known in which the seat and back of the chair can be rocked back and forth as a unit. This latter type of chair is generally classified as a swivel rocker.

Typically, swivel rocker chairs have been employed as casual furniture, for example of the outdoor type. However, in the past, the mechanisms which permit a chair to rotate about a vertical axis and to rock about a horizontal axis have been relatively heavy and bulky in appearance. Further, in many cases, the rocking action which has been obtained has been relatively hard in that when the chair is rocked forward, the chair comes to a dead stop forward position.

Accordingly, it is an object of the invention to provide a connection unit for a swivel rocker which is of relatively light weight.

It is another object of the invention to provide a swivel rocker which does not come to a dead stop forward position when in use.

It is another object of the invention to provide a swivel rocker with a soft rocking action.

It is another object of the invention to provide a swivel rocker with a stable seating action during a rocking phase.

Briefly, the invention provides a swivel rocker which is comprised of a base having an upstanding stem, a chair frame and a connection unit connecting the chair frame to the base.

In accordance with the invention, the connection unit includes a vertical pivot pin which is rotatably mounted in the stem of the base for rotatably supporting the chair frame on the base. In addition, the connection unit has a pair of parallel flexures secured to the chair frame for supporting the chair frame on the base for rocking in a vertical plane. Each flexure is of U-shape with a pair of parallel legs disposed horizontally and facing rearwardly. Hence, during a rocking motion, the ends of the legs approach each other during a rearward phase of a rocking motion while becoming spread apart during a forward phase of the rocking motion. Thus, as the chair frame approaches a rearwardmost position or a forwardmost position, the resistance of the flexures to further flexing increases so as to slowly bring the rocking action of the chair to a soft stop before returning the chair in the opposite rocking direction.

The connection unit for the swivel rocker also employs a composite beam which is secured transversely of and to the pivot pin for pivoting therewith. This composite beam serves to mount the U-shaped flexures thereon at opposite ends so as to provide a wide stance to the flexures thereby isolating the front and back rocking of the chair frame to eliminate sideways motion of the chair frame. In this way, a stable rocking effect may be obtained by an occupant of the swivel rocker.

The composite beam is constructed of a first flat plate which is secured to the pin and a second contoured plate below the first plate through which the pivot pin passes. In addition, the ends of the two plates are sandwiched about the respective ends of the flexures with suitable means, such as a nut and bolt assembly, being used to secure the ends of the plates together in clamping relation to a respective end of a flexure.

These and other objects and advantages of the invention will become more apparent from the following detailed description taken in conjunction with the accompanying drawings wherein.

Figure 1:
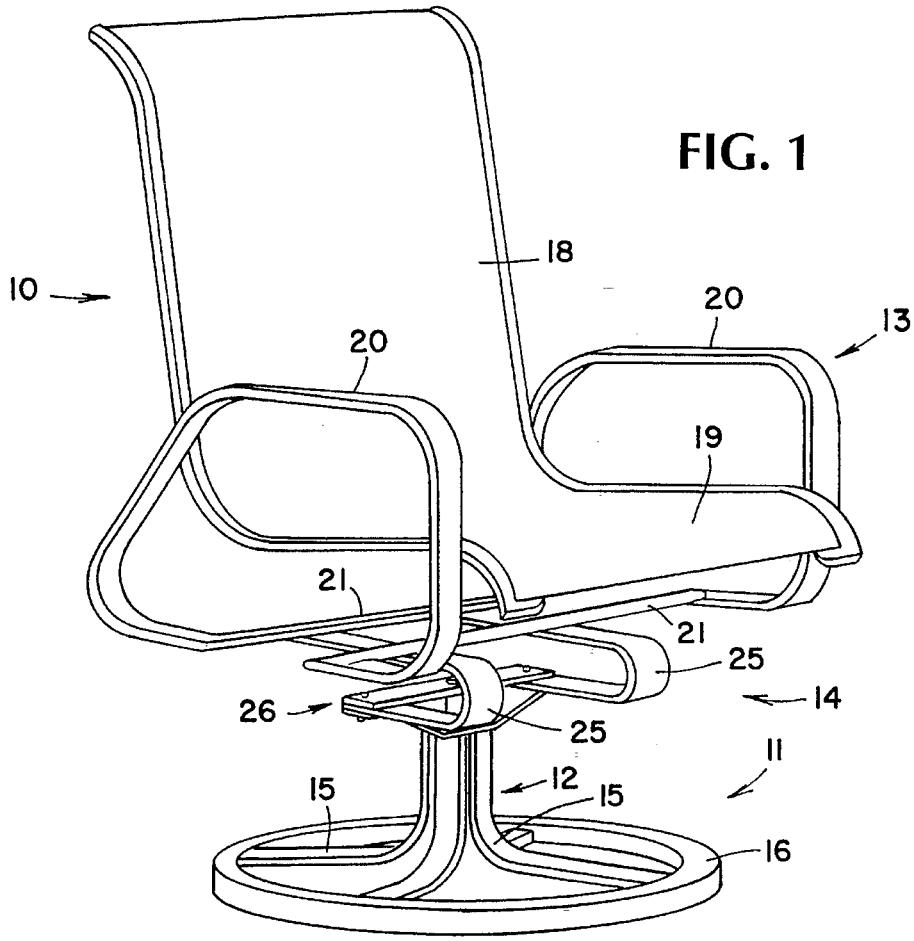
FIG. 1 illustrates a perspective front view of a swivel rocker constructed in accordance with the invention.

Referring to FIG. 1, the swivel rocker 10 is constructed of a base 11 having an upstanding stem 12, a chair frame 13 and a connection unit 14 connecting the chair frame 13 to the base 11.

Figure 4:
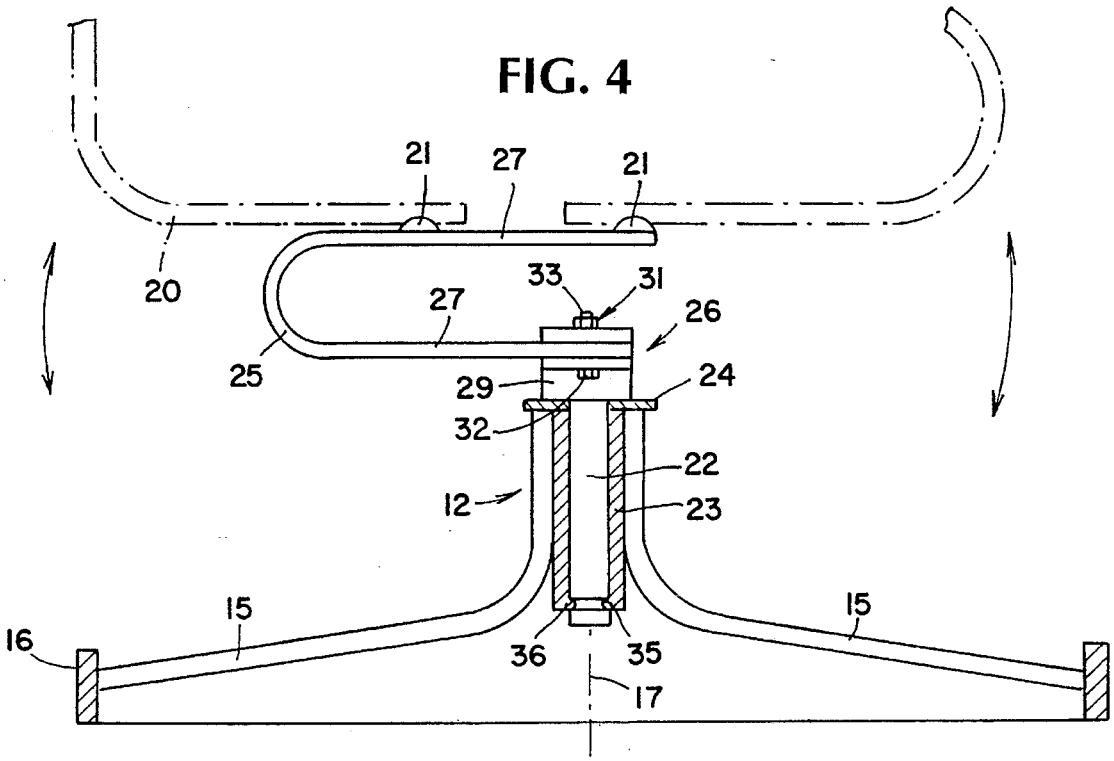
FIG. 4 illustrates a view taken on line 4—4 of FIG. 3 of the connection unit in place.

Referring to FIGS. 1 and 4, the base 11 is formed, for example, by four L-shaped legs 15 and a ring 16 secured to and about the legs 15. As illustrated, the legs 15 are disposed about a common vertical axis 17 so that the legs 15, in part, define the upstanding stem 12. In the alternative, the base 11 may be of any other suitable construction.

Referring to FIG. 1, the chair frame 13 is of any suitable construction. For example, the chair frame 13 includes a unit which forms a back rest 18 and a seat 19. This unit may include a metallic frame across which a mesh fabric or the like is stretched to form the back rest 18 and seat 19. In addition, the chair frame 13 includes a pair of side arms 20 each of which is secured, as by welding, to the metallic frame of the unit to form an integrated body. Each arm 20 may be hollow with a flattened cross-sectional shape. As shown, a pair of support rails 21 are secured across the two side arms 20 under the seat 19 and are secured, as by welding, to the side arms 20. In this way, a rigid chair frame 13 is formed. Alternatively, the arms 20 and support rails 21 may be formed of a one piece unit in an endless loop manner.

Figure 2:
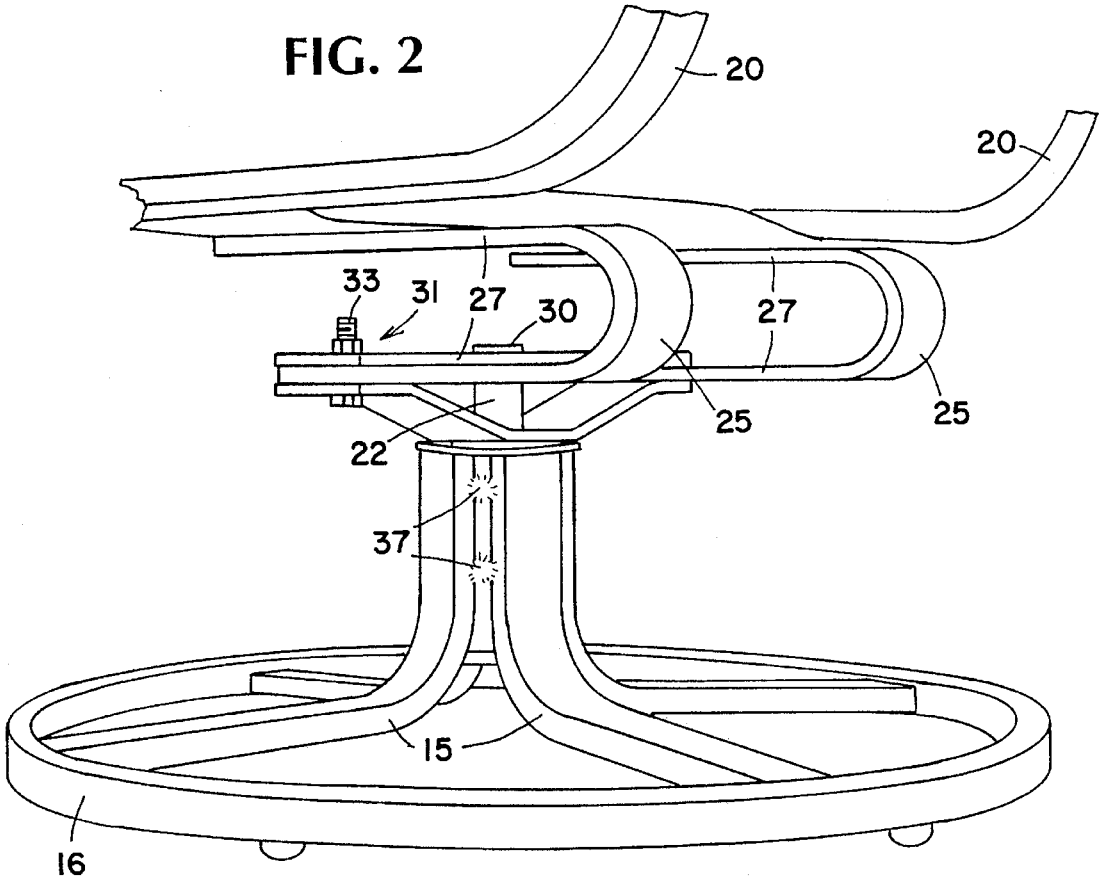
FIG. 2 illustrates a partial view of the swivel rocker of FIG. 1.

Referring to FIGS. 2 and 4, the connection unit 14 includes a hollow vertical pivot pin 22 which is rotatably mounted within the stem 12 in the base 11. In this regard, the stem 12 is provided with a bearing sleeve 23, for example, of plastic to rotatably receive the pivot pin 22. The sleeve 23 is also connected with a bearing plate 24, for example, of plastic which receives the connection unit 14 thereon in bearing relation. In this regard, the sleeve 23 and bearing plate 24 may be made of a one-piece unit.

The connection unit 14 also includes a pair of U-shaped flexures 25 and a composite beam 26 which secures the flexures 25 with the pivot pin 22.

As shown in FIGS. 1, 2 and 4, each flexure 25 is made, for example of aluminum, and has a pair of legs 27 disposed in parallel overlying relation. In addition, the flexures 25 face forwardly so that the free ends of the legs 27 are disposed rearwardly of the swivel rocker 10, i.e. the back rest 18 is disposed in a plane spaced rearwardly of the flexures 25.

Referring to FIG. 2, the composite beam 26 is secured transversely of and to the pin 22 for pivoting therewith. In this respect, the composite beam 26 is formed of a first flat plate 28, for example, of rectangular shape and a second contoured plate 29 located below the rectangular plate 28. The hollow pin 22 is formed with a shoulder at the upper end on which the flat plate 28 sits. In addition, the upper end of the pin 22 passes through the plate 28 and is provided with a rolled over portion 30 at the top which serves to secure the pin 22 and upper plate 28 together. For example, the rolled over portion 30 may be formed by a peening operation. The contoured plate 29 is provided with an opening so as to slidably receive the pin 22 therein.

As shown in FIG. 2, the ends of the plates 28, 29 are sandwiched about the respective ends of the legs 27 of the flexures 25 and are clamped thereto by a nut and bolt assembly 31. As indicated, each assembly 31 includes a bolt 32 which passes through the ends of the plates 28, 29 and a flexure 25 as well as a nut 33 which is threaded unto the bolt 32.

The flexures 25 are secured to the composite beam 26 in parallel laterally spaced apart relation so as to impart a sidewise stability to the mounting of the chair frame 13 on the base 11. That is, the flexures 25 provide a wide stance so that the chair frame 13 is prevented from rocking from side-to-side relative to the base 11.

The components of the connection unit 14 may each be made of aluminum so as to provide a light weight but strong construction.

Figure 3:
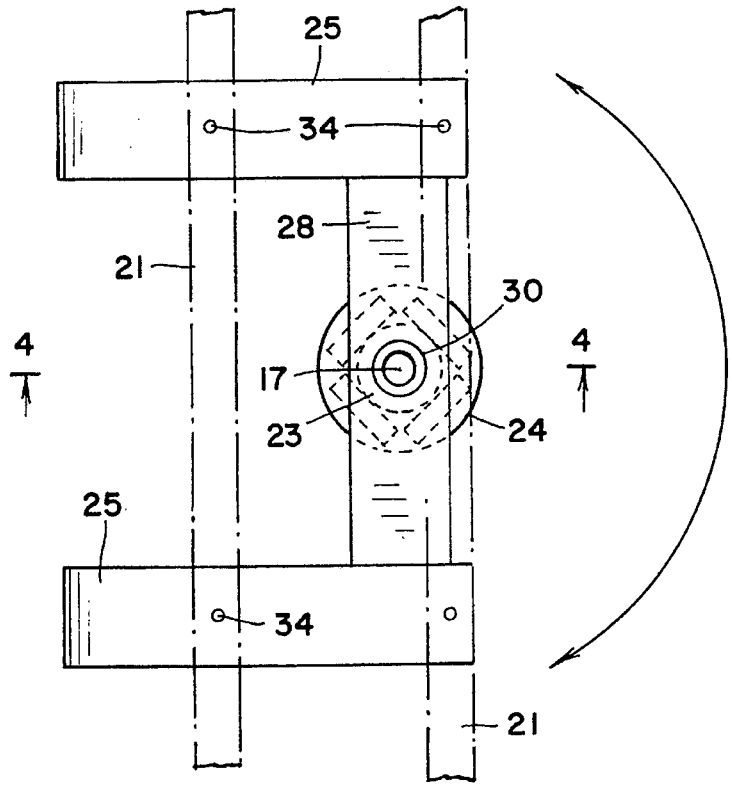
FIG. 3 illustrates a plan view of the connection unit of the swivel rocker in accordance with the invention.

Referring to FIGS. 3 and 4, the upper leg 27 of each flexure 25 is provided with a pair of threaded openings 34 so as to receive bolts (not shown) for securing each flexure 25 to the pair of support rails 21 of the chair frame 13. In the alternative, a welded connection may be made between the flexures 25 and the support rails 21 particularly when the rails 21 are integral with the arms 20 in the endless loop embodiment.

Referring to FIG. 1, when an occupant is seated in the chair frame 13, the weight of the occupant is transferred through the support rails 21 onto the upper leg 27 of each flexure 25. This causes the two legs 27 of the flexure 25 to move towards each other at the free ends. Should the occupant decide to rock back and forth, the free ends of the legs 27 of the flexures 25 move toward and away from each other. During this time, as the legs 27 move towards each other, the restoring force of the flexures 25 increases and restrains the rearward rocking of the occupant while a similar restoring force is effected during a forward rocking phase to restrain the forward rocking of the occupant. In this way, a soft rocking action is effected particularly at the end of each of the rearmost and forwardmost rocking positions.

The horizontal bearing plate 24 allows the connection unit 14 to rotate freely about the vertical axis 17. In this respect, the central part of the contoured plate 29 of the composite beam 26 has a flat surface to provide a relatively wide bearing area on the bearing plate 24 for this pivoting motion. The contoured shape of the lower plate 29 also provides the composite beam 26 with a shape which imparts rigidity to the connection unit 14 relative to a side-to-side rocking motion.

Referring to FIG. 4, the hollow pivot pin 22 may be provided with an annular groove 35 at the lower end while the plastic sleeve 23 is formed with two integral ears 36 directed inwardly and downwardly at the end of the sleeve to snap into the annular groove 35.

In order to assemble the swivel rocker 10, The connection unit 14 may be handled as a separate unit and may be secured as a unit by welding or bolting to the support rails 21 of the chair frame 13. Thereafter, the pivot pin 22 of the connection unit 14 may be simply slid into place In the sleeve 23 located in the stem 12 of the base 11. When the pivot pin 22 passes through the sleeve 23 in the base stem 12, the ears 36 at the end of the sleeve 23 are biased outwardly to allow the pivot pin 22 to pass. When the groove 35 is moved into position, the ears 36 spring inwardly into the groove 35 to lock the connection unit 14 to the base stem 12.

Referring to FIG. 2, suitable tack welds 37 may be used to secure the upstanding portions of the legs 15 together.

The invention thus provides a connection unit for a swivel rocker which is of relatively lightweight construction.

Further, the invention provides a connection unit for a swivel rocker which provides for a soft rocking motion while providing stability against side-to-side motions.

What is claimed is:

1. A swivel rocker comprising a base having an upstanding stem;

a chair frame; and a connection unit connecting said chair frame to said base, said connection unit including a vertical pivot pin rotatably mounted in said stem of said base for rotatably supporting said chair frame on said base, a composite beam secured to and transversely of said pin, said beam including a first flat plate secured to said pivot pin and a second contoured plate transverse to said pivot pin, and a pair of parallel flexures secured to said chair frame and between opposite ends of said plates of said composite beam for supporting said chair frame on said base for rocking in a vertical plane.

2. A swivel rocker as set forth in claim 1 wherein said base includes a plurality of L-shaped legs defining said stem and a ring secured to and about said legs.

3. A swivel rocker as set forth in claim 1 which further comprises means securing said plates of said composite beam together to clamp said flexures therebetween.

4. A swivel rocker as set forth in claim 1 wherein each flexure is of U-shape, with a pair of parallel legs disposed horizontally.

5. A swivel rocker as set forth in claim 4 wherein said chair frame includes a seat and a backrest, said backrest being disposed in a plane spaced rearwardly of said flexures.

6. A swivel rocker as set forth in claim 1 wherein said stem includes a sleeve slidably receiving said pivot pin.

7. A swivel rocker as set forth in claim 6 wherein said pin has an annular groove and said sleeve has a pair of ears disposed in said groove to secure said connection unit to said base.

8. A swivel rocker as set forth in claim 6 wherein said stem include a horizontally disposed bearing plate secured to said sleeve and slidably supporting said connection unit thereon.

9. A connection unit for a swivel rocker comprising a pivot pin;

a composite beam secured transversely of and to said pin for pivoting therewith, said composite beam including a first flat plate secured to said pin and a second contoured plate below said first plate with said pin passing therethrough; and a pair of parallel U-shaped flexures, each flexure having one end secured between said plates of said beam at a respective end of said composite beam and extending perpendicularly therefrom.

10. A connection unit as set forth in claim 9 wherein each flexure has a pair of parallel horizontally disposed legs.

11. A connection unit as .set forth in claim 9 which further comprises a pair of nut and bolt assemblies, each nut and bolt assembly securing respective ends of said plates together in clamping relation to a respective end of a respective flexure.

12. A connection unit as set forth in claim 9 wherein said pin is secured to said beam centrally thereof.

13. A connection unit as set forth in claim 9 wherein said pin is hollow.

14. A swivel rocker comprising a base having an upstanding stem;

a chair frame; and a connection unit connecting said chair frame to said base, said connection unit including a vertical pivot pin rotatably mounted in said stem of said base for rotatably supporting said chair frame on said base, a first flat plate secured to said pivot pin, a second contoured plate transverse to said pivot pin, a pair of parallel flexures secured between said plates and secured to said chair frame for supporting said chair frame on said base for rocking in a vertical plane, and means securing said plates together to clamp said flexures therebetween.

* * * * *

UNITED STATES PATENT AND TRADEMARK OFFICE

CERTIFICATE OF CORRECTION

PATENT NO. : 5,599,064

DATED : Feb. 4, 1997

INVENTOR(S) : Robert Vanderminden

It is certified that error appears in the above-indentified patent and that said Letters Patent is hereby corrected as shown below:

Column 3, line 56, change "The" to -the-

Line 60, change "In" to -in-

Column 4, line 30, cancel ","

Line 42, change "include" to -includes-

Signed and Sealed this

Twenty-ninth Day of April, 1997

*Attest:*

*Attesting Officer*

BRUCE LEHMAN

*Commissioner of Patents and Trademarks*